US009746827B2

(12) United States Patent
Ogawa et al.

(10) Patent No.: US 9,746,827 B2
(45) Date of Patent: Aug. 29, 2017

(54) IMAGE FORMING APPARATUS AND DRYING DEVICE

(71) Applicants: Masato Ogawa, Kanagawa (JP); Tomonori Tamura, Kanagawa (JP)

(72) Inventors: Masato Ogawa, Kanagawa (JP); Tomonori Tamura, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/182,756

(22) Filed: Jun. 15, 2016

(65) Prior Publication Data

US 2016/0370758 A1 Dec. 22, 2016

(30) Foreign Application Priority Data

Jun. 17, 2015 (JP) ..... 2015-122020

(51) Int. Cl.

| | |
|---|---|
| ***G03G 21/20*** | (2006.01) |
| ***B41J 11/00*** | (2006.01) |
| *F26B 13/10* | (2006.01) |

(52) U.S. Cl.

CPC ..... *G03G 21/206* (2013.01); *B41J 11/002* (2013.01); *F26B 13/10* (2013.01)

(58) Field of Classification Search

None

See application file for complete search history.

(56) References Cited

U.S. PATENT DOCUMENTS

2010/0188469 A1* 7/2010 Ikegami ..... B41J 3/543 347/102

FOREIGN PATENT DOCUMENTS

| | | |
|---|---|---|
| JP | 2006-276215 | 10/2006 |
| JP | 2012-073419 | 4/2012 |
| JP | 2014-177102 | 9/2014 |

* cited by examiner

*Primary Examiner* — Clayton E Laballe
*Assistant Examiner* — Jas Sanghera
(74) *Attorney, Agent, or Firm* — Cooper & Dunham LLP

(57) ABSTRACT

An image forming apparatus includes a drying section, a cooling section, and an exhaust section. The drying section dries a recording medium on which an image is formed. The cooling section cools the recording medium dried by the drying section. The exhaust section exhausts air from the drying section and the cooling section through an exhaust port. The exhaust section includes a plurality of flow path determiners disposed on opposing walls of the exhaust section, to form an air flow path from the drying section to the exhaust port. The plurality of flow path determiners alternately projects from the opposing walls.

17 Claims, 8 Drawing Sheets

IMAGE FORMING APPARATUS AND DRYING DEVICE

CROSS-REFERENCE TO RELATED APPLICATION

This patent application is based on and claims priority pursuant to 35 U.S.C. §119(a) to Japanese Patent Application No. 2015-122020, filed on Jun. 17, 2015 in the Japan Patent Office, the entire disclosure of which is hereby incorporated by reference herein.

BACKGROUND

Technical Field

Aspects of the present disclosure relate to an image forming apparatus and a drying device.

Related Art

The temperature inside an image forming apparatus, such as a copier, a multifunction peripheral, a printer, and a facsimile machine, is controlled to be kept high for drying ink used for printing and a print sheet used for printing. From a viewpoint of management of the temperature relating to maintenance of performance in the printing process and prevention of melting of parts, for example, heat is exhausted to the outside of the image forming apparatus after completion of print output of a sheet to rapidly cool the inside of the image forming apparatus.

Moisture contained in a sheet and ink evaporates under high temperature during a print output. Therefore, if moisture in the vapor inside the image forming apparatus condenses by cooling, there is a concern of causing a short in an electric circuit or degrading printing quality.

SUMMARY

In an aspect of the present disclosure, there is provided an image forming apparatus that includes a drying section, a cooling section, and an exhaust section. The drying section dries a recording medium on which an image is formed. The cooling section cools the recording medium dried by the drying section. The exhaust section exhausts air from the drying section and the cooling section through an exhaust port. The exhaust section includes a plurality of flow path determiners disposed on opposing walls of the exhaust section, to form an air flow path from the drying section to the exhaust port. The plurality of flow path determiners alternately projects from the opposing walls.

In an aspect of the present disclosure, there is provided a drying device that includes a drying section, a cooling section, and an exhaust section. The drying section dries a recording medium on which an image is formed. The cooling section cools the recording medium dried by the drying section. The exhaust section exhausts air from the drying section and the cooling section through an exhaust port. The exhaust section includes a plurality of flow path determiners disposed on opposing walls of the exhaust section, to form an air flow path from the drying section to the exhaust port. The plurality of flow path determiners alternately projects from the opposing walls.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
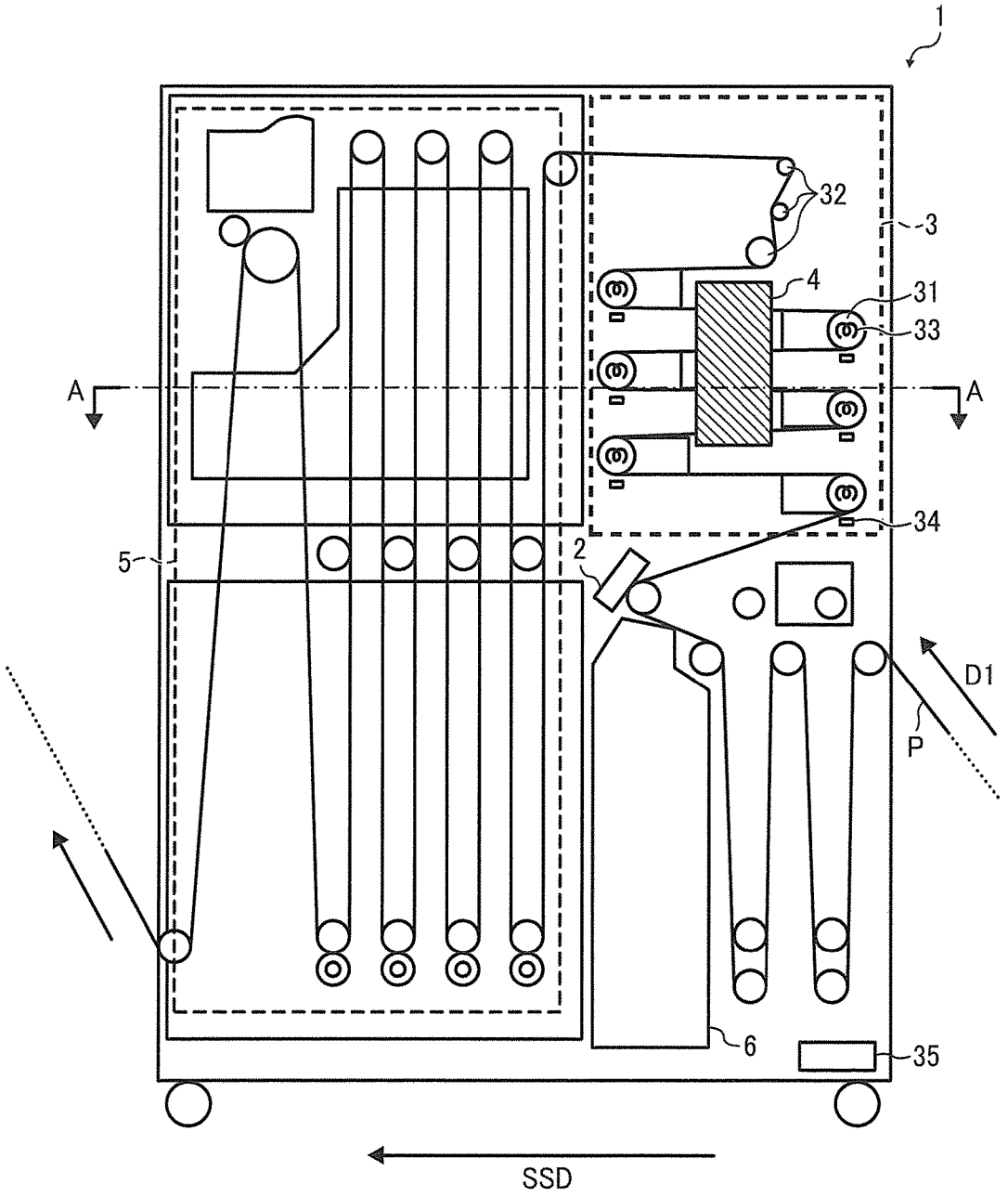
FIG. 1 is a side view of a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 6:
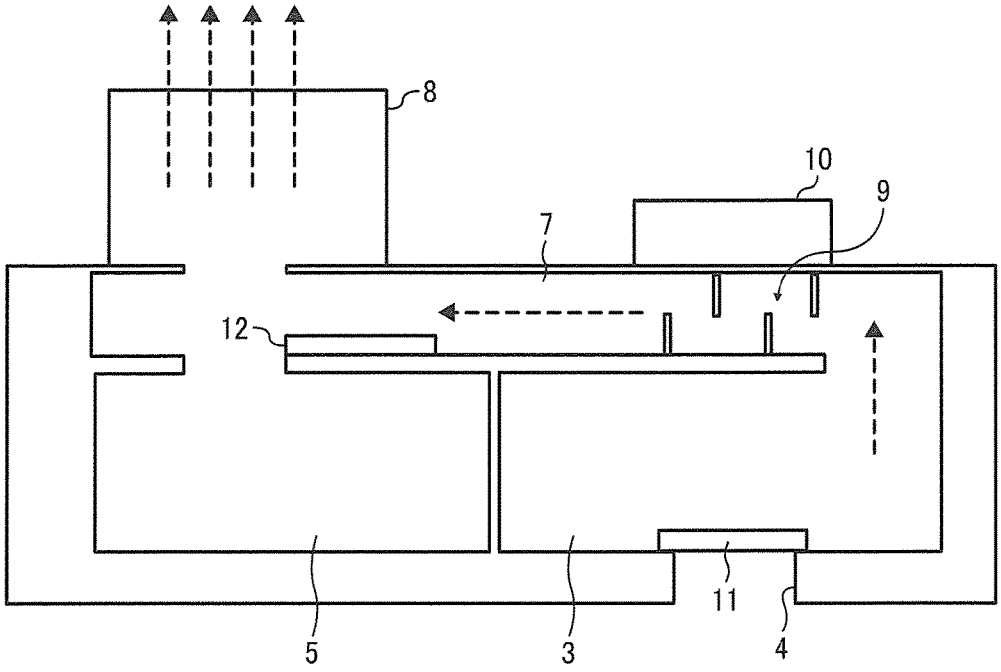
FIG. 6 is an illustration of a configuration of an exhaust duct during a print output.

Hereinafter, embodiments of the present disclosure are described with reference to the drawings. A configuration of an image forming apparatus according to the present disclosure will now be described based on an image forming apparatus 1 illustrated in FIG. 1 and FIG. 6. FIG. 1 is a side view of the configuration of the image forming apparatus 1 viewed in a sub-scanning direction indicated by arrow SSD. FIG. 6 is a sectional view of the image forming apparatus 1 taken along a broken line A-A in FIG. 1.

The image forming apparatus 1 illustrated in FIG. 1 includes a print unit 2, a drying section 3, an opening 4, a cooling section 5, and a liquid collection unit 6.

The print unit 2 discharges liquid droplets, such as ink droplets, from a print nozzle onto a recording medium P to perform printing. The ink discharged from the print nozzle but is not used for printing is introduced to the liquid collection unit 6 to be collected separately from the recording medium P.

The drying section 3 includes heating rollers 31 and conveyance rollers 32. Each heating roller 31 includes a heater 33 inside and heats the recording medium P to fix the ink which has been discharged onto the recording medium P by drying. The drying section 3 thus acts as a sheet drying device. The heating method of the heater 33 in each heating roller 31 may be any suitable method. In this embodiment, for example, as illustrated in FIG. 1, the temperatures of the heaters 33 are measured by temperature detecting elements 34, such as resistance temperature detectors or thermocouples, and controlled to a setting temperature by a temperature controller 35. The conveyance rollers 32 are arranged to convey the recording medium P to a cooling section 5 via the heating rollers 31. The conveyance rollers 32 include a drive roller that is driven by a drive source and driven rollers, e.g., idler rollers driven by the conveyed recording medium P. In some embodiments, the conveyance roller 32 may include, for example, the temperature detecting element 34 to detect the temperature in the drying section 3.

Figure 2:
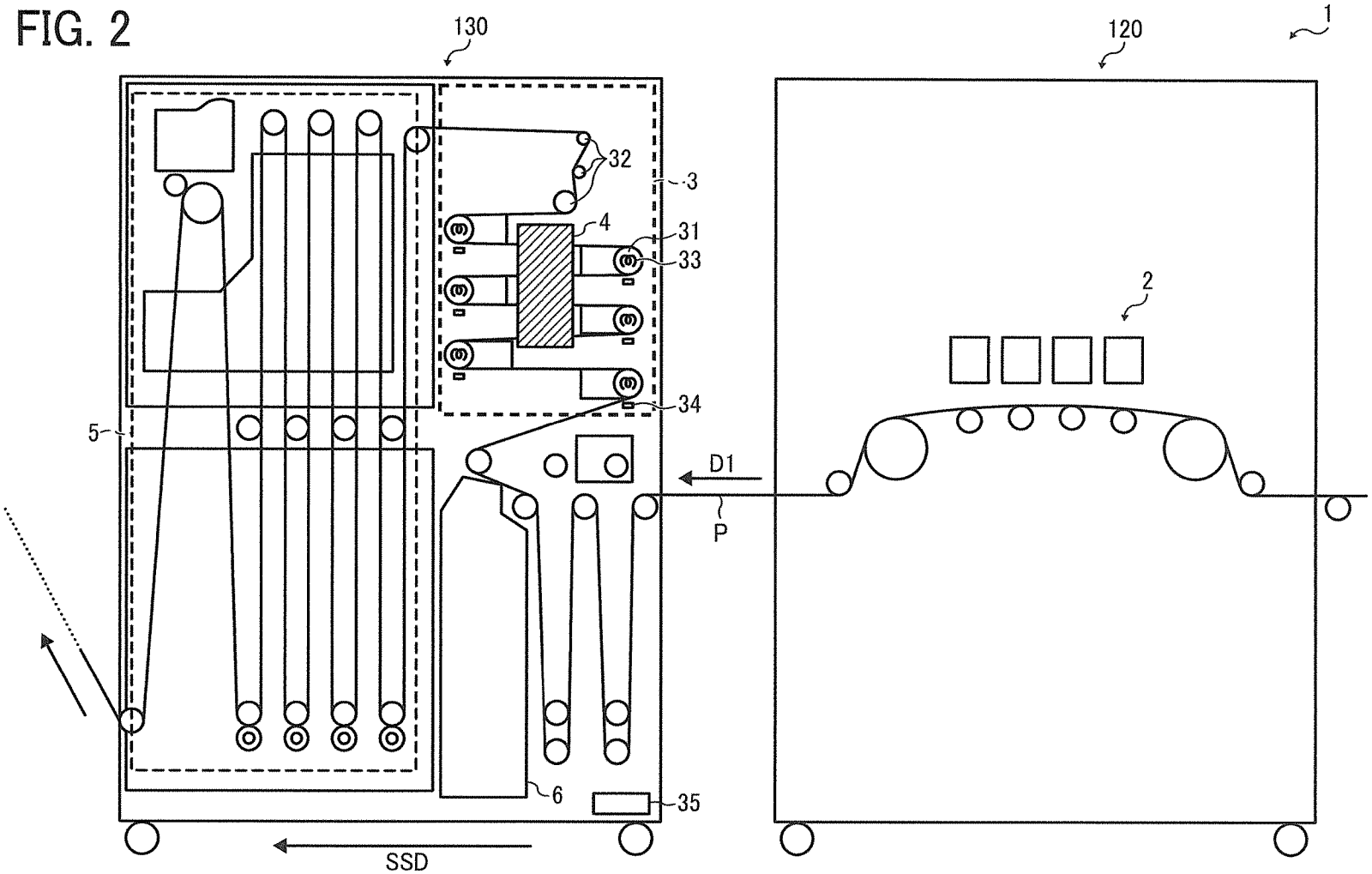
FIG. 2 is a side view of a configuration of an image forming apparatus according to another embodiment of the present disclosure.

In some embodiments, as illustrated in FIG. 2, an image forming apparatus 1 may include a sheet drying device 130 including the drying section 3 separately from a printing device 120 including the print unit 2.

The opening 4 is provided to take air into the drying section 3 from the outside of the image forming apparatus 1. When a front panel 13, which will be described later, is closed, the inside of the image forming apparatus 1 cannot be viewed from outside.

The cooling section 5 cools the recording medium P conveyed from the drying section 3 and includes an internal fan and a conveyance roller. The internal fan is driven to cool the surface of the recording medium P. Similar to the conveyance rollers 32 in the drying section 3, the conveyance rollers of the cooling section 5 include a rotation roller (drive roller) and idler rollers. The recording medium P cooled in the cooling section 5 is conveyed by the conveyance roller to the outside of the image forming apparatus 1.

The liquid collection unit 6 is provided vertically below the fin 9. The ink that is not used for printing and a liquid component in the image forming apparatus 1 are introduced to and collected in the liquid collection unit 6 and temporarily stored. The collected liquid component is discarded as required.

As illustrated in FIG. 6, the image forming apparatus 1 includes an exhaust duct 7, an exhaust device 8, fins 9, a fan 10, a drying-section partition 11, and a cooling-section partition 12.

The exhaust duct 7 is a path to exhaust air outside from the image forming apparatus 1, and is disposed downstream from the drying section 3 in the path through which air in the image forming apparatus 1 is exhausted outside. Therefore, the exhaust duct 7 corresponds to an exhaust section in the image forming apparatus 1. The cooling-section partition 12 separates the exhaust duct 7 from the cooling section 5. By moving the cooling-section partition 12, exhaust air in the cooling section 5 can be ejected through the exhaust duct 7. Internal surfaces of the exhaust duct 7 other than where the fins 9, which will be described later, are provided are waterproofed, and therefore do not catch water and solvent contained in exhaust air.

The exhaust device 8 suctions exhaust air from the exhaust duct 7 and exhausts the air to the outside of the image forming apparatus 1. The exhaust device 8 is provided most downstream in the path along which exhaust air is transferred to eject the exhaust air to the outside of the image forming apparatus 1. Therefore, the exhaust device 8 corresponds to an exhaust port of the image forming apparatus 1.

A plurality of fins 9 each made of a steel plate or an aluminum plate is provided on opposing internal walls of the exhaust duct 7 to project alternately toward the opposing wall. The fins 9 are cooled by the cool air from the outside of the image forming apparatus 1 and a fan 10, which will be described later. The angle of the plate surface of the fin 9 to the internal wall of the exhaust duct 7 is controlled by, for example, a solenoid or a motor, to change the projection height of the fin 9 from the internal wall of the exhaust duct 7. The flow path of air in the exhaust duct 7 changes with the change in the projection height of the fin 9, which means that the fin 9 acts as a flow path determiner.

The fan 10 is provided behind the fin 9 and outside the exhaust duct 7 to reduce the temperature around the fin 9.

The drying-section partition 11 is provided to take in air from the outside of the image forming apparatus 1 through the opening 4, and is movable to close the opening 4. By closing the opening 4 with the drying-section partition 11, the inside of the drying section 3 can be sealed to prevent a temperature drop in the drying section 3 during drying of the recording medium P.

The cooling-section partition 12 is provided to control the inflow of air from the cooling section 5 into the exhaust duct 7, and is movable to separate or adjoin the cooling section 5 and the exhaust duct 7. By using the cooling-section partition 12, the inflow of air from the cooling section 5 into the exhaust duct 7 can be closed.

Figure 12:
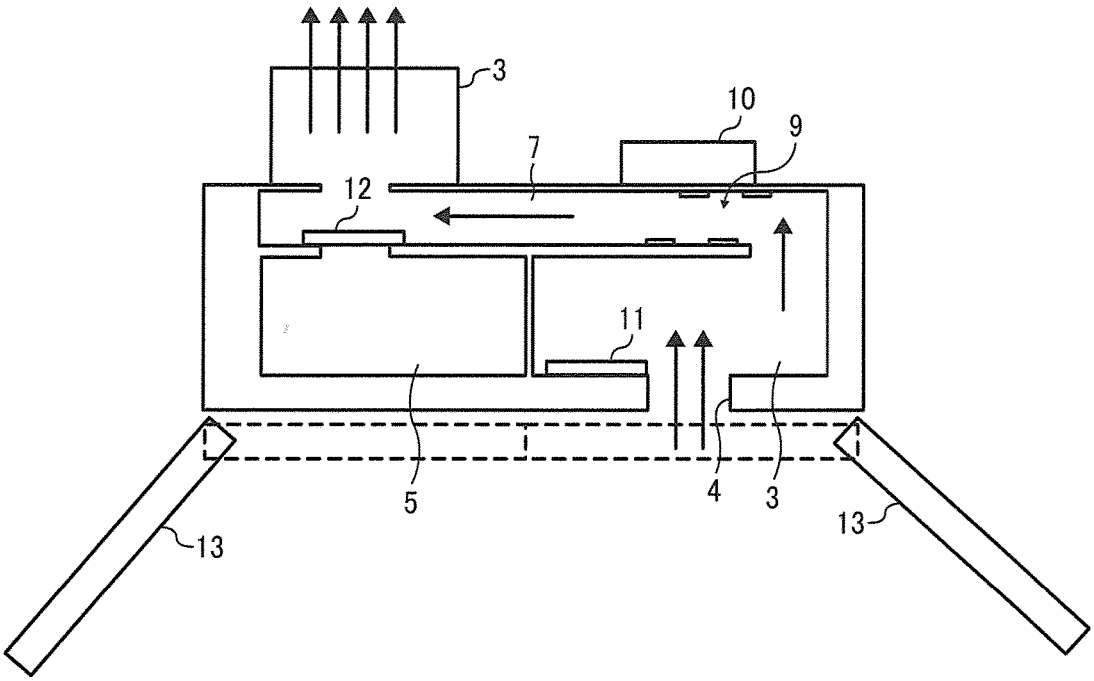
FIG. 12 is an illustration of a configuration of the exhaust with a front panel opened.

The image forming apparatus 1 according to the embodiment includes the front panel 13 as illustrated in FIG. 12. The front panel 13 is provided to cover the drying section 3 and the cooling section 5. When the front panel 13 is closed, the inflow of air from the outside through the opening 4 is reduced. When the front panel 13 is opened, air can be taken from the outside into the drying section 3 through the opening 4. The front panel 13 is opened, for example, for maintenance of the image forming apparatus 1.

Figure 3:
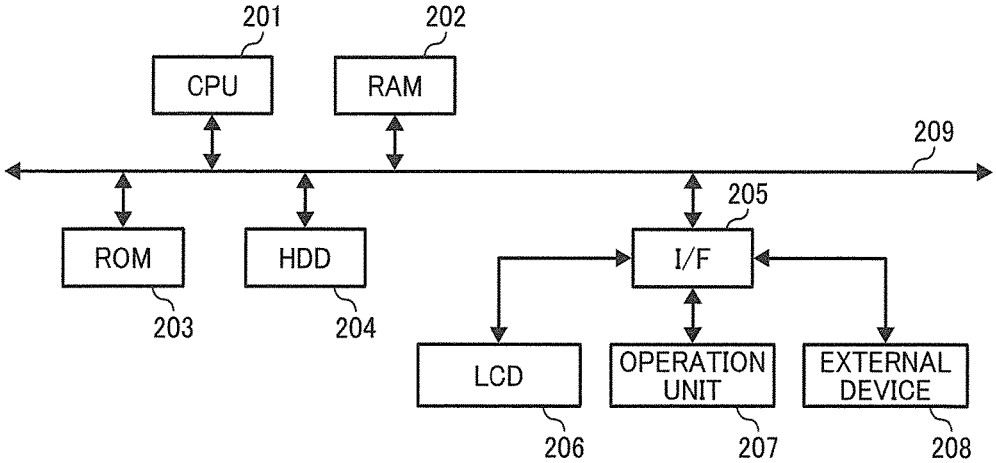
FIG. 3 is a diagram of hardware configuration of an image forming apparatus according to an embodiment of this disclosure.

A configuration of hardware of the image forming apparatus 1 will be described below referring to FIG. 3. FIG. 3 is a block diagram of a hardware configuration of the image forming apparatus 1 according to the present embodiment.

As illustrated in FIG. 3, the image forming apparatus 1 according to the present embodiment is similar in configuration to an information processing terminal, such as a general server or a personal computer (PC). That is, in the image forming apparatus 1 according to the present embodiment, a central processing unit (CPU) 201, a random access memory (RAM) 202, a read only memory (ROM) 203, a hard disk drive (HDD) 204, and an interface (I/F 205 are connected to each other via a bus 209. The I/F 205 is connected with a liquid crystal display (LCD) 206 and an operation unit 207. Signals are transmitted and received to/from an external device 208 connected to the image forming apparatus 1 via the I/F 205.

The CPU 201 is an arithmetic unit and controls the operation of the entire image forming apparatus 1. The RAM 202 is a volatile storage medium capable of reading and writing information at a high speed and is used as a working area during information processing of the CPU 201. The ROM 203 is a read-only non-volatile storage medium and stores a program, such as firmware. The HDD 204 is a non-volatile storage medium capable of reading and writing information and stores operating system (OS), various control programs, application programs, for example.

The I/F 205 connects the bus 209 with various types of hardware and networks and performs control. The LCD 206 is a visual user interface for a user confirming the state of the image forming apparatus 1. The operation unit 207 is a user interface, such as a keyboard or a mouse, for the user inputting information to the image forming apparatus 1. The external device 208 is hardware for realizing a specific function of the image forming apparatus 1, and is, for example, a print engine for executing an image forming operation on the recording medium.

In such a hardware configuration, the programs stored in the ROM 203 and the HDD 204 or a storage medium, such as an optical disk, are read by the RAM 202, and an arithmetic operation is performed according to the programs loaded in RAM 202 by the CPU 201 to configure a software controller. The software controller configured in this way is combined with the hardware to configure a functional block for realizing functions of the image forming apparatus 1 according to the present embodiment.

Figure 4:
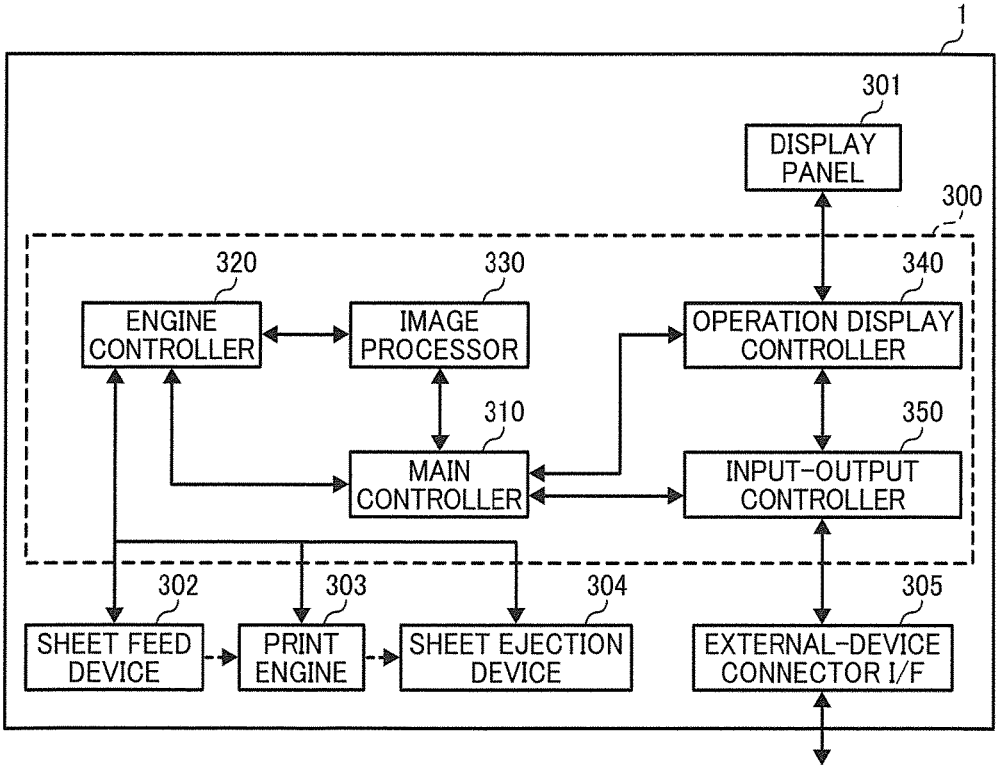
FIG. 4 is a functional block diagram of an internal configuration of an image forming apparatus according to an embodiment of this disclosure.

Next, referring to a functional block diagram of the image forming apparatus 1 according to the present embodiment illustrated in FIG. 4, a functional configuration of the image forming apparatus 1 will be described. As illustrated in FIG. 4, the image forming apparatus 1 includes a controller 300, a display panel 301, a sheet feed device 302, a print engine 303, a sheet ejection device 304, and an external-device connector interface (I/F) 305.

The controller 300 includes a main controller 310, an engine controller 320, an image processor 330, an operation display controller 340, and an input-output controller 350. In FIG. 4, electrical connections are indicated by solid arrows, and a flow of sheet of paper is indicated by a broken line.

The display panel 301 is not only an output interface that visually displays status of the image forming apparatus 1 but also an input interface (operation unit) that a user directly operates the image forming apparatus 1 using a touch panel or inputs information to the image forming apparatus 1. The external-device connector interface (I/F) 305 is an interface for communicating other devices through a network or an inter-device connection cable, and Ethernet (registered trademark) and universal serial bus (USB) interface are used for the external-device connector interface (I/F) 305.

The controller 300 is configured by a combination of software and hardware. For example, the controller 300 is constituted by the software controller constructed by computation of the CPU 201 as described above and hardware, such as integrated circuits. The controller 300 functions as a controller that controls the entire image forming apparatus 1.

The main controller 310 plays a role of controlling each unit included in the controller 300 and gives commands to each unit of the controller 300. The engine controller 320 serves as a driver that controls and drives the print engine 303.

The input-output controller 350 inputs signals and commands input through the external-device connector interface (I/F) 305 to the main controller 310. The main controller 310 controls the input-output controller 350 and accesses other devices through the external-device connector interface (I/F) 350.

The image processor 330 generates drawing information based on print information included in a print job to be input according to the control of the main controller 310. The drawing information is information that the print engine 303 as an image forming unit draws as an image to be formed in an image forming operation. The print information included in the print job is image information that is converted into a format recognizable by the image forming apparatus 1 by a printer driver installed in an information processing device, such as a PC. The operation display controller 340 displays information on the display panel 301 or notifies information input through the display panel 301 to the main controller 310.

In the image forming apparatus 1, first, the input-output controller 350 receives a print job through the external-device connector interface (I/F) 305. The input-output controller 350 transfers the received print job to the main controller 310. When receiving the print job, the main controller 310 controls the image processor 330 to generate drawing information based on print information included in the print job.

When the drawing information is generated by the image processor 330, the engine controller 320 executes an image forming operation on the sheet fed from the sheet feed device 302, based on the generated drawing information. That is, the print engine 303 functions as an image forming unit. A document subjected to the image forming operation by the print engine 303 is ejected to the outside of the apparatus by the sheet ejection device 304.

In the image forming apparatus 1, the printing unit 2 corresponding to the print engine 303 performs the image forming operation on the recording medium P fed in a sheet feed direction (indicated by arrow D1 in FIG. 1) from the sheet feed device 302, a drying section 3, and a cooling section 5. The recording medium P is discharged by the sheet ejection device 304 to the outside of the image forming apparatus 1.

As described above, the image forming apparatus 1 controls the temperature in the drying section 3 to be kept high during image forming to dry ink adhering to the recording medium P. Meanwhile, from a viewpoint of management of the temperature relating to maintenance of performance in the printing process and prevention of melting of parts, the inside of the image forming apparatus 1 need to be cooled rapidly after completion of a print output. In such a case, if the exhaust air containing moisture evaporated from ink and the recording medium P under high temperature is rapidly cooled, the moisture may condense and remain in the image forming apparatus 1 to cause effects. To prevent remaining of condensed moisture, the exhaust air may be ejected to the outside of the apparatus through, for example, a moisture-absorption filter. Such a configuration however may fail to maintain the performance under the increased exhaust air volume during continuous printing, for example, and cause deterioration in the cooling efficiency of the image forming apparatus 1.

The present disclosure is directed to efficiently performing cooling and drying by switching modes in the image forming apparatus 1 between a mode that prioritizes exhaustion of a large amount of air and a mode that prioritizes dehumidification inside the apparatus.

Figure 5:
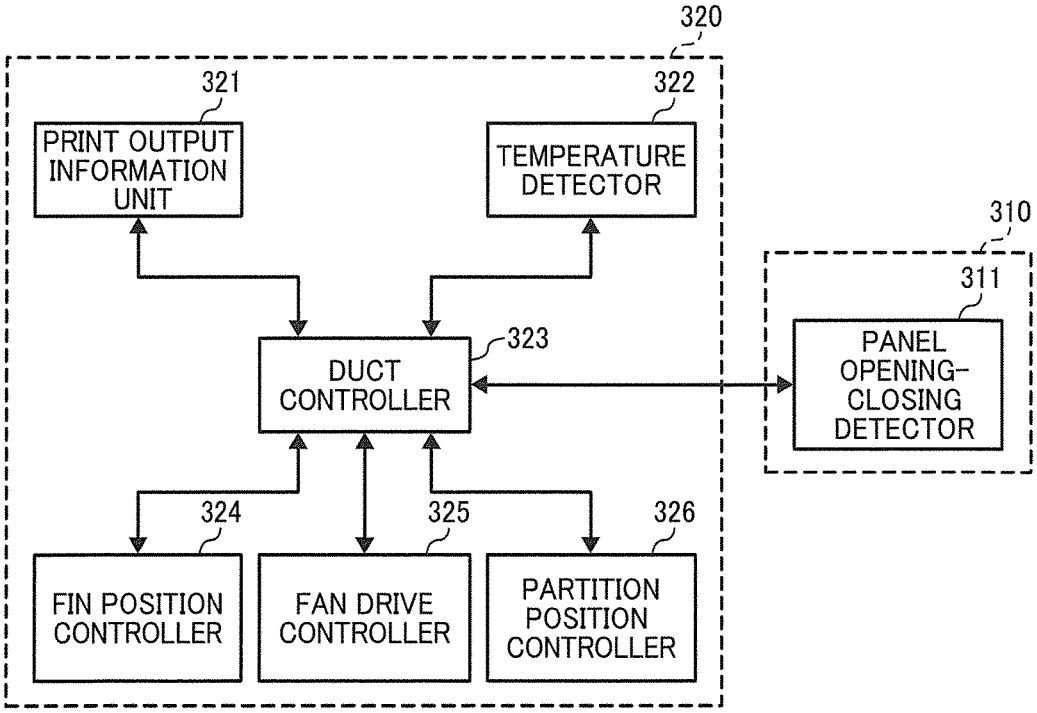
FIG. 5 is a control block diagram of a duct controller according to the embodiment of this disclosure.

A functional structure of components inside the exhaust duct 7 according to the embodiment will now be described with reference to a control block diagram of the components inside the exhaust duct 7 illustrated in FIG. 5. As illustrated in FIG. 5, the engine controller 320 performs a drive control of components in the exhaust duct 7 with reference to the information for controlling the operation of the image forming apparatus 1 acquired from the main controller 310.

A print output information unit 321 is included in the engine controller 320 and outputs to the duct controller 323 the information indicating that a print engine 303 is performing a print output.

A temperature detector 322 is included in the engine controller 320 and outputs to the duct controller 323 the information on temperatures detected by temperature detecting elements in the heating roller 31 and the drying section 3.

A duct controller 323 is included in the engine controller 320 and outputs information for controlling components inside the exhaust duct 7 based on the information received by the duct controller 323. These components are the fin 9, the fan 10, the drying-section partition 11, and the cooling-section partition 12. An aspect of the control will be described later.

A fin position controller 324 is included in the engine controller 320 and controls the fin 9 based on the control information transmitted from the duct controller 323.

A fan drive controller 325 is included in the engine controller 320 and controls the fan 10 based on the control information transmitted from the duct controller 323.

A partition position controller 326 is included in the engine controller 320 and controls the drying-section partition 11 and the cooling-section partition 12 based on the control information transmitted from the duct controller 323.

A panel opening-closing detector 311 is included in the main controller 310 and detects whether the front panel 13 of the image forming apparatus 1 is opened or closed. The panel opening-closing detector 311 outputs the information indicating the detected result to the duct controller 323.

Figure 7:
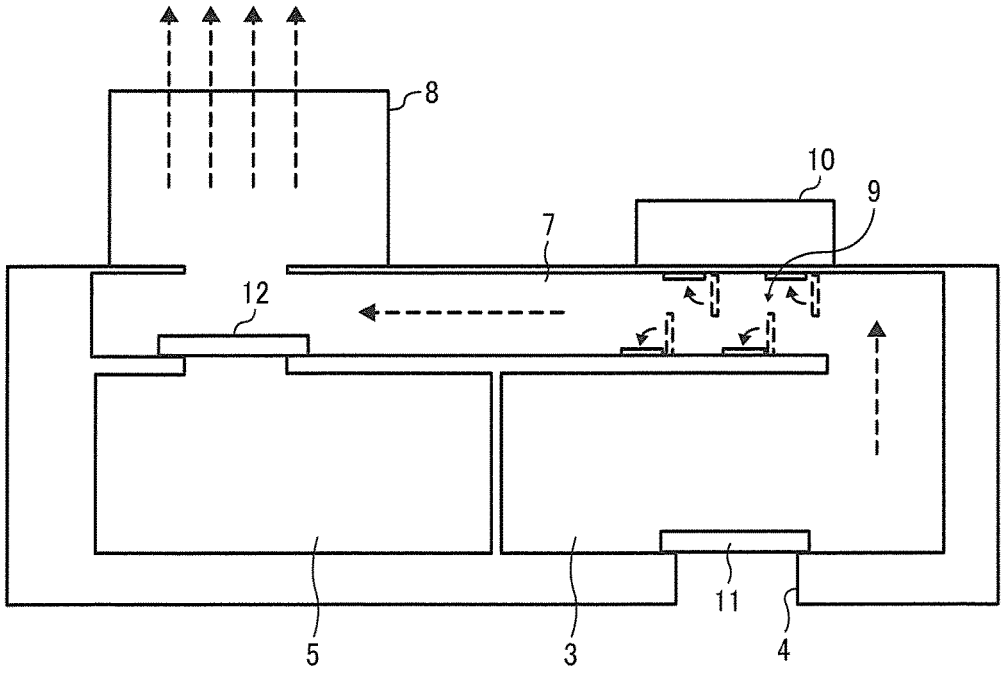
FIG. 7 is an illustration of a configuration of the exhaust duct after completion of a print output.
Figure 8:
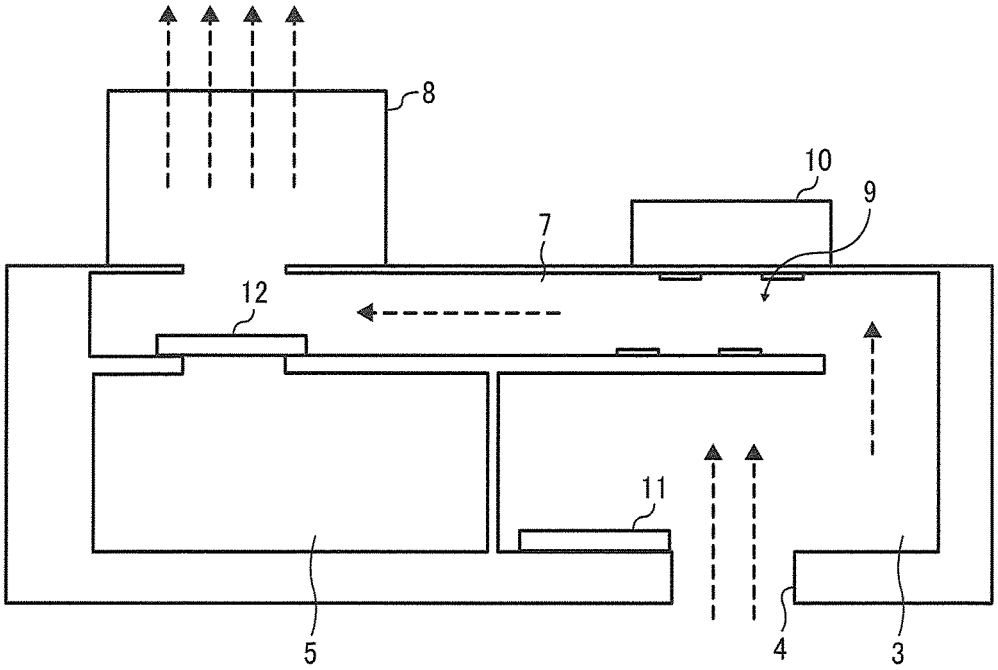
FIG. 8 is an illustration of a configuration of the exhaust duct after completion of a print output.

FIGS. 6 to 8 illustrate an example of the duct controller 323 controlling the components inside the exhaust duct 7. The control of components inside the exhaust duct 7 and the object of the control will be described below with reference to the drawings. FIGS. 6 to 8 are sectional views of the image forming apparatus 1 taken along the broken line A in FIG. 1.

FIG. 6 is an illustration of a configuration of the exhaust duct 7 when an image is formed and output in the image forming apparatus 1. During image formation and output, the moisture in ink and the recording medium P evaporates by the heat from the heating roller 31, and humidity inside the image forming apparatus 1 rises. The object of the control illustrated in FIG. 6 is to rapidly cool the exhaust air containing a large amount of moisture so that the moisture condenses into water and then the water is introduced to and collected in the liquid collection unit 6.

When image formation and output are not performed as illustrated in FIG. 6, the duct controller 323 positions the fins 9 to project vertical to the wall of the exhaust duct 7 and moves the cooling-section partition 12 so that the exhaust air in the exhaust duct 7 mixes with the air in the cooling section 5. Furthermore, the duct controller 323 moves the drying-section partition 11 to close the opening 4, and thereby dropping of the internal temperature in the drying section 3 is prevented to promote drying of the recording medium P.

By controlling the components inside the exhaust duct 7 to increase the flow path length of exhaust air, the exhaust air containing a large amount of moisture is cooled by the fins 9 to condense into water and to be introduced to the liquid collection unit 6. The ejection of the air, of which temperature has risen by cooling the recording medium P, in the cooling section 5 is promoted.

FIG. 7 is an illustration of a configuration of the exhaust duct 7 after completion of image formation and output in the image forming apparatus 1. After completion of image formation and output cooling of the image forming apparatus 1 is desirably prioritized from a viewpoint of preventing melting of parts and maintaining printing quality of the image forming apparatus 1. The object of the control illustrated in FIG. 7 is to switch modes to increase the amount of exhaust flow in the exhaust duct 7 to prioritize the cooling of the image forming apparatus 1.

After completion of image formation and output of an image, the duct controller 323 positions the fins 9 to be parallel to the exhaust duct 7 as illustrated in FIG. 7. The duct controller 323 also moves the cooling-section partition 12 to prevent the exhaust air in the cooling section 5 from flowing into the exhaust duct 7.

To prioritize cooling of the image forming apparatus 1, the components inside the exhaust duct 7 are controlled to increase the amount of exhaust flow in the exhaust duct 7. In the control illustrated in FIG. 7, the drying-section partition 11 is controlled to prevent the air in the outside of the image forming apparatus 1 from flowing in through the opening 4. By operating the exhaust device 8 under such a control, the moisturized exhaust air in the drying section 3 can efficiently be suctioned into the exhaust duct 7.

FIG. 8 is an illustration of a configuration of the exhaust duct 7 when image formation and output are not performed in the image forming apparatus 1. After completion of a print output, the drying section 3 need to be cooled rapidly. The object of the control illustrated in FIG. 8 is to increase the inflow of exhaust air through the drying section 3 to promote cooling of the drying section 3.

When image formation and output are not performed, the duct controller 323 positions the fins 9 to be parallel to the exhaust duct 7 as illustrated in FIG. 8. By this configuration, there is no obstacle in the exhaust path in the exhaust duct 7, and the amount of exhaust flow from the drying section 3 can be increased. The duct controller 323 also moves the drying-section partition 11 to open the opening 4, so that the air in the outside of the image forming apparatus 1 flows into the drying section 3 to further promote cooling of the image forming apparatus 1.

By controlling the components inside the exhaust duct 7, the amount of exhaust flow ejected to the outside of the image forming apparatus 1 through the drying section 3 can be increased to further promote the cooling of the image forming apparatus 1.

Figure 9:
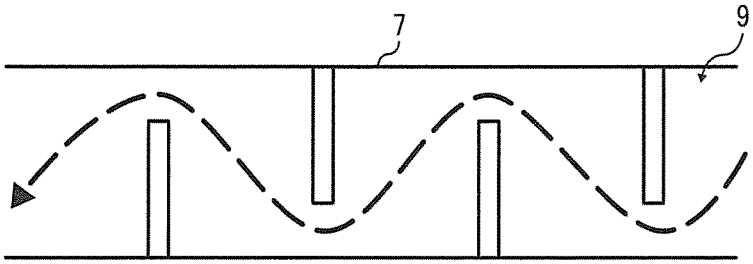
FIG. 9 is an illustration of fin control in which drying of the image forming apparatus is prioritized.
Figure 10:
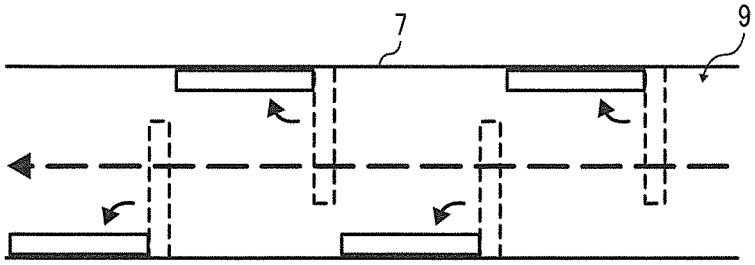
FIG. 10 is an illustration of fin control in which cooling of the image forming apparatus is prioritized.

FIGS. 9 and 10 are illustrations explaining the fin position controller 324 controlling the positions of the fins 9. The control of the positions of the fins 9 and an effect by the control will now be described.

FIG. 9 is an illustration of the exhaust path where the fins 9 are placed to project vertical to the exhaust duct 7 by the fin position controller 324. As described in the control of the components inside the exhaust duct 7, the fins 9 projecting vertical to the exhaust duct 7 increase the length of the air flow path, which promotes cooling of exhaust air. The vertically placed fins 9 thus efficiently cool the exhaust air to condense moisture into water, which can be collected in the liquid collection unit 6.

FIG. 10 is an illustration of the exhaust air flow path where the fins 9 are placed parallel to the exhaust duct 7 by the fin position controller 324. As described in the control of the components inside the exhaust duct 7, when the fins 9 are placed parallel to the exhaust duct 7, there is no obstacle in the air flow path, so that the amount of exhaust flow from the drying section 3 increases. By positioning the fins 9 to be parallel to the exhaust duct 7, the ejection of exhaust air from the image forming apparatus 1 can be performed efficiently, thereby promoting the cooling of the image forming apparatus 1.

Figure 11:
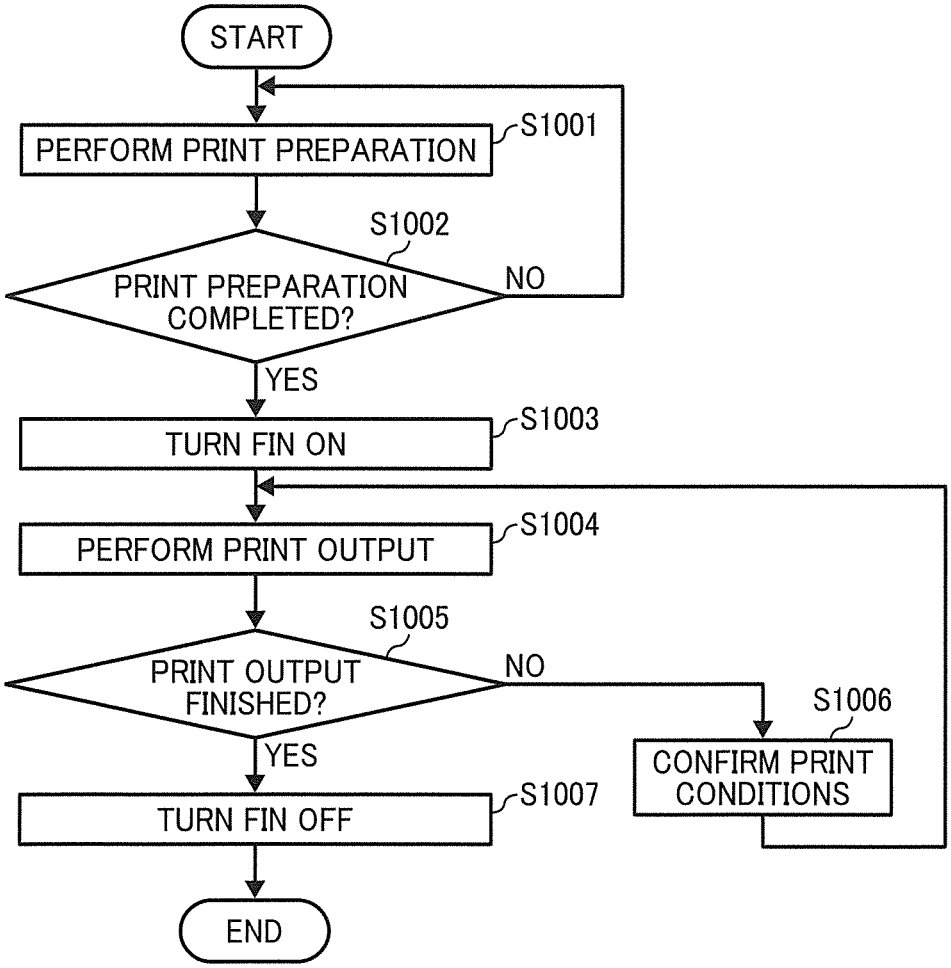
FIG. 11 is a flowchart of a process of controlling a fin with relation to a print output.

FIG. 11 is a flowchart of a process to control the positions of fins 9 based on information on a print output. The control of the positions of fins 9 will now be described in detail with reference to FIG. 11.

When image information is input to the image forming apparatus 1, the engine controller 320 receives the drawing information for printing to start print preparation (S1001). The state of the print preparation may be determined at the timing when the engine controller 320 receives the drawing information. The print preparation may include various conditions, for example, whether the recording medium P is set in the image forming apparatus 1, whether sufficient amount of ink required of print output is ready, or whether the image forming apparatus 1 has recovered from an energy save mode.

Then, the print output information unit 321 determines whether the print preparation has been completed (S1002). Completion of the print preparation is determined according to whether conditions in S1001 have been satisfied. If the print preparation has not been completed ("NO" in S1002), the print output information unit 321 executes the processing of S1001 again.

If the print preparation has been completed ("YES" in S1002), the print output information unit 321 transmits to the duct controller 323 the print output information for performing print output.

On receiving the print output information, the duct controller 323 transmits to the fin position controller 324 the control information for keeping the fins 9 vertical to the exhaust path. Instructed by the control information, the fin position controller 324 positions the fins 9 to be vertical to the exhaust path ("FIN ON" in S1003).

Based on the received drawing information, the engine controller 320 performs a print output on the recording medium P (S1004). The duct controller 323 determines whether the print output has been completed (S1005). Completion of the print output is determined considering whether the print output has been performed on a predetermined number of recording media P or whether a signal instructing forced termination of printing is input to the engine controller 320.

If the print output has not been completed ("NO" in S1005), the duct controller 323 checks the print condition (S1006). If there is no abnormality, the process returns to S1005. The print condition to be checked is, for example, whether the recording medium P has been used up before completion of printing or whether the temperature in the image forming apparatus 1 has become abnormal. In other words, whether the state of the image forming apparatus 1 allows continuing of print output is checked.

If the print output is completed ("YES" in S1005), the duct controller 323 transmits to the fin position controller 324 the control information for positioning the fins 9 to be parallel to the exhaust duct 7. Instructed by the control information, the fin position controller 324 positions the fins 9 to be parallel to the exhaust duct 7 ("FIN OFF" in S1007).

The partition position controller 326 controls the positions of the drying-section partition 11 and the cooling-section partition 12 based on the control information transmitted from the duct controller 323 When the fins 9 are set to the on-state, the drying-section partition 11 is controlled to be placed to close the opening 4, and the cooling-section partition 12 is controlled to be placed so as the exhaust air in the cooling section 5 to be mixed with the exhaust air in the exhaust duct 7 and the mixed exhaust gas to be ejected to the outside of the image forming apparatus 1 (see FIG. 6). When the fins 9 are set to the off-state, the cooling-section partition 12 is controlled to be placed so as the exhaust air in the cooling section 5 and the exhaust air in the exhaust duct 7 not to be mixed with each other. The drying-section partition 11 is still in a state of closing the opening 4 in this state (see FIG. 7).

When the fins 9 are placed to be parallel to the exhaust duct 7, the drying-section partition 11 is placed to open the opening 4. The cooling-section partition 12 is placed to separate the cooling section 5 from the exhaust duct 7 so that the exhaust air in the cooling section 5 and the exhaust air in the exhaust duct 7 do not mix with each other (see FIG. 8).

The rotation of the fan 10 can be controlled according to temperatures of the exhaust duct 7 and the fins 9 detected by the temperature detector 322. The fan 10 is controlled to rotate when the temperature in the exhaust duct 7 or of the fins 9 exceeds a predetermined temperature (for example, 60° C.) so that the external face of the exhaust duct 7 and the fins 9 are cooled. The fan 10 can be controlled to always rotate when the fins 9 are set to the on-state. In such a case, the duct controller 323 transmits to the fan drive controller 325 the control information for rotating the fan 10 when the fins 9 are set to the on-state among the controls of the fins 9 illustrated in FIG. 11.

A control similar to the process illustrated in FIG. 8 may be performed during the maintenance of the image forming apparatus 1 to promote cooling of the image forming apparatus 1. FIG. 12 is an illustration of a configuration of the exhaust duct 7 with the front panel 13 of the image forming apparatus 1 opened.

The front panel 13 is provided to close the opening 4. When the front panel 13 is opened, the panel opening-closing detector 311 outputs to the duct controller 323 the information indicating that the front panel 13 is opened, and thereby the image forming apparatus 1 performs the control illustrated in FIG. 8. A further larger amount of air can then be taken into the inside of the image forming apparatus 1 through the opening 4, so that the amount of exhaust flow is further increased, thereby raising the cooling efficiency of the image forming apparatus 1.

As described above, the image forming apparatus 1 according to the embodiment controls, based on print output information, which modes to be selected between the mode that prioritizes removal of moisture in the exhaust air and the mode that prioritizes exhaustion of a large amount of air. Controlled in such a manner, either the mode that prioritizes the removal of moisture inside the image forming apparatus 1 and the mode that prioritizes the cooling inside the apparatus is selected. Consequently, the image forming apparatus to which the present disclosure is applied can remove liquid in exhaust air without reducing the amount of exhaust flow, thereby efficiently performing cooling and drying.

The embodiment described above merely presents an exemplary embodiment of the present disclosure, but does not limit the scope of the present disclosure. Various embodiments can be set forth without departing from the technical scope of the present disclosure. For example, the temperature in the drying section 3 may become very high during a large number of continuous print outputs. When such an abnormally high temperature in the drying section 3 is detected, the control illustrated in FIG. 8 may be performed to cool the drying section 3 before the next print output is performed, instead of immediately performing the next print output. With such a control, a print output can be performed with stable quality.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image for forming apparatus comprising:

a heating section to heat a recording medium;

and an exhaust section to exhaust air from the heating section through an exhaust port, the exhaust section including a plurality of flow path determination members, to form an air flow path from the heating section to the exhaust port, one flow path determination member amongst the plurality of flow path determination members being disposed on a first wall of the exhaust section, and another flow path determination member amongst the plurality of flow path determination members being disposed on a second wall opposing the first wall of the exhaust section, said one flow path determination member and said another flow path determination members disposed on the first and second walls, respectively, overlap in a direction in which the opposing first and second walls oppose each other.

2. The image forming apparatus according to claim 1, wherein each of the plurality of flow path determination members projects vertical to the opposing first and second walls.

3. The image forming apparatus according to claim 1, wherein a projection height of the plurality of flow path determination members from the opposing first and second walls of the exhaust section is changeable.

4. The image forming apparatus according to claim 1, wherein a projection height of the plurality of flow path determination members from the opposing first and second walls of the exhaust section is smaller when image formation and output are not performed than when the image formation and the output are performed.

5. The image forming apparatus according to claim 1, wherein each of the plurality of flow path determination members is a plate, and wherein a projection height of the plurality of flow path determination members from the opposing first and second walls changes with a change in an angle of the plate relative to the wall.

6. The image forming apparatus according to claim 1, wherein each of the plurality of flow path determination members is placed parallel to the opposing first and second walls when image formation and output are not performed.

7. The image forming apparatus according to claim 1, further comprising:

a cooling section disposed to cool the recording medium heated by the heated section;

a heating-section partition to close an opening of the heating section; and a cooling-section partition to separate the cooling section from the exhaust section, wherein the cooling-section partition is placed adjacent to the exhaust section when image formation and output are performed, and wherein the heating-section partition is placed to open the opening when the image formation and the output are not performed.

8. The drying device according to claim 1, wherein said one flow path determination member disposed on the first wall and said another flow path determination member disposed on the second wall are disposed at different respective positions on the first wall and the second wall, respectively, in a direction perpendicular to the direction in which the first wall and the second wall oppose each other.

9. The drying device according to claim 1, further comprising:

a cooling section to cool the recording medium heated by the heating section, the cooling section being connected to the exhaust section at a position closer than the plurality of flow path determination members to the exhaust port.

10. A drying device comprising:

a heating section to heat a recording medium;

and an exhaust section to exhaust air from the heating section through an exhaust port, the exhaust section including a plurality of flow path determination members, to form an air flow path from the heating section to the exhaust port, one flow path determination member amongst the plurality of flow path determination members being disposed on a first wall of the exhaust section, and another flow path determination member amongst the plurality of flow path determination members being disposed on a second wall opposing the first wall of the exhaust section, said one flow path determination member and said another flow path determination members overlap in a direction in which the opposing first and second walls oppose each other.

11. The drying device according to claim 10, wherein each of the plurality of flow path determination members projects vertical to the opposing first and second walls.

12. The drying device according to claim 10, wherein a projection height of each of the plurality of flow path determination members from the opposing first and second walls of the exhaust section is changeable.

13. The drying device according to claim 10, wherein a projection height of each of the plurality of flow path determination members from the first and second opposing walls of the exhaust section is smaller when image formation and output are not performed than when the image formation and the output are performed.

14. The drying device according to claim 10, wherein each of the plurality of flow path determination members is a plate, and wherein a projection height of each of the plurality of flow path determination members from the first and second opposing walls changes with a change in an angle of the plate relative to the wall.

15. The drying device according to claim 10, wherein the plurality of flow path determination members is placed parallel to the first and second opposing walls when image formation and output are not performed.

16. A drying device according to claim 10, further comprising:

a cooling section disposed to cool the recording medium heated by the heated section;

a heating-section partition to close an opening of the heating section; and a cooling-section partition to separate the cooling section from the exhaust section, wherein the cooling-section partition is placed adjacent to the exhaust section when image formation and output are performed, and wherein the heating-section partition is placed to open the opening when the image formation and the output are not performed.

17. A drying device comprising:

a heating section to heat a recording medium;

an exhaust section to exhaust air from the heating section through an exhaust port, the exhaust section including a plurality of flow path determination members to form an air flow path from the heating section to the exhaust port; and a liquid collection unit disposed vertically below the plurality of flow path determination members, to collect a liquid component.

* * * * *